US009620069B2

(12) United States Patent
Xu

(10) Patent No.: US 9,620,069 B2
(45) Date of Patent: Apr. 11, 2017

(54) METHOD FOR COMPENSATING IMPEDANCES OF DATA LINES OF LIQUID CRYSTAL DISPLAY

(71) Applicant: SHENZHEN CHINA STAR OPTOELECTRONICS TECHNOLOGY CO., LTD., Shenzhen, Guangdong (CN)

(72) Inventor: Xiangyang Xu, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 504 days.

(21) Appl. No.: 14/240,387

(22) PCT Filed: Jan. 22, 2014

(86) PCT No.: PCT/CN2014/071104
§ 371 (c)(1),
(2) Date: Feb. 22, 2014

(87) PCT Pub. No.: WO2015/100821
PCT Pub. Date: Jul. 9, 2015

(65) Prior Publication Data

US 2015/0185575 A1 Jul. 2, 2015

(30) Foreign Application Priority Data

Dec. 31, 2013 (CN) ..... 2013 1 0751723

(51) Int. Cl.
*G09G 3/36* (2006.01)
*G09G 3/00* (2006.01)

(52) U.S. Cl.
CPC ..... *G09G 3/3611* (2013.01); *G09G 3/006* (2013.01); *G09G 2300/0426* (2013.01); *G09G 2320/0223* (2013.01); *G09G 2320/0285* (2013.01)

(58) Field of Classification Search
CPC ..... G02F 1/136286; G02F 1/1345; G02F 1/1343; G09G 3/36; G09G 3/3611;
(Continued)

(56) References Cited

U.S. PATENT DOCUMENTS 6,252,566 B1 * 6/2001 Maurice ..... G09G 3/3648 345/100

FOREIGN PATENT DOCUMENTS

CN 103337233 A 10/2013
TW 538602 B 6/2003

OTHER PUBLICATIONS

International Search Report mailed Jul. 30, 2014, issued to International Application No. PCT/CN2014/071104.

* cited by examiner

*Primary Examiner* — Toan Le
(74) *Attorney, Agent, or Firm* — Stein IP, LLC

(57) ABSTRACT

The present disclosure relates to the technical field of liquid crystal display, and particularly, relates to a method for compensating impedances of data lines of a liquid crystal display. The method includes the following steps: a setting step of setting a memory and a subtracter; a measuring step of measuring the impedance value of a data line to be compensated, and inputting the impedance value into the memory; a calculating step of performing calculations with the impedance value measured in the measuring step through the subtracter, so as to obtain an impedance compensation value required by the respective data line; and a compensating step of reading out the impedance compen-
(Continued)

sation value acquired in the calculating step through a data driving unit, and performing impedance compensation on the respective data line based on the impedance compensation value, in order to obtain a total load impedance for the respective data line. A uniform, satisfactory display effect can be ensured, with display defects, such as vertical black and white strips, color shift and the like, advantageously prevented.

16 Claims, 6 Drawing Sheets

METHOD FOR COMPENSATING IMPEDANCES OF DATA LINES OF LIQUID CRYSTAL DISPLAY

FIELD OF THE INVENTION

The present disclosure relates to the technical field of liquid crystal display, and particularly, relates to a method for compensating impedances of data lines of a liquid crystal display.

BACKGROUND OF THE INVENTION

Aiming at a reduced manufacturing cost and a lowered price of a panel, the design of a data driving unit (source IC) has been widely used in large-sized panels.

FIG. 1 schematically shows a structural diagram of an array substrate of a thin-film transistor liquid crystal display. With reference to FIG. 1, a total quantity of 2n data lines of the display is shown, and the data lines are successively numbered from one side to the other side in the drawing. Reference signs X(1), X(2), . . . , X(n−1), X(n) . . . , X(2n−1) and X(2n) indicate 2n data lines of the liquid crystal display respectively.

FIG. 1 further shows a structural schematic diagram of a panel with a data driving unit (source IC) in the prior art. With reference to FIG. 1, for a large-sized panel, the impedance difference between the central data line on the panel close to the data driving unit (source IC) and two end data lines on the panel away from the data driving unit (source IC) is relatively large.

FIG. 2 schematically shows data line impedance under an ideal condition, wherein the horizontal coordinate indicates the numbers of the data lines, while the vertical coordinate indicate the impedance values of the data lines designated with different numbers. In FIG. 2, R0 schematically indicates an ideal impedance, i.e. a reference value for impedance compensation, with the black solid line schematically illustrating the impedance values of the data lines of different numbers under the ideal condition, and RI schematically indicates the minimum impedance value of the data lines under the ideal condition. It could be seen that under the ideal condition, the impedance values of the data lines constitute a decreasing arithmetic progression from data line X(1) to data line X(n), and an increasing arithmetic progression from data line X(n+1) to data line X(2n), respectively. The impedance values corresponding to data lines X(n) and X(n+1) are minimum, and thus form the minimum impedance value R1 for the data lines.

FIG. 3 schematically shows compensation impedances under the ideal condition, wherein the horizontal coordinate indicates the numbers of data lines, and the longitudinal coordinate indicates impedance compensation values. As shown in FIG. 3, for the purpose of compensating unequal impedances of the data lines due to different positions, fixed impedance compensation may be performed in the data driving unit (source IC) on the basis of the impedance differences between different data lines. The black solid line schematically illustrates the impedance compensation values of the data lines designated with different numbers under the ideal condition. It could be seen from FIG. 3 that under the ideal condition, the impedance compensation values of the data lines constitute an increasing arithmetic progression from data line X(1) to data line X(n), and a decreasing arithmetic progression from data line X(n+1) to data line X(2n), respectively. The impedance compensation values corresponding to the data lines X(n) and X(n+1) are maximum, which equal the value of R0-R1 as shown in FIG. 2, namely, the difference between the ideal impedance value and the minimum impedance value of the data lines.

FIG. 4 shows a total load impedance of a data driving unit under the ideal condition. It could be seen that the function curve of the total load impedance shows a straight line under the ideal condition, which means that total load impedance values corresponding to all the data lines are equal with the ideal impedance value R0.

However, FIG. 2, FIG. 3 and FIG. 4 are merely directed to the results of impedance compensation technical solutions under the ideal condition in the prior art. Now the practical results of impedance compensation for data lines will be introduced below in conjunction with FIG. 5, FIG. 6 and FIG. 7.

In practical situations, due to the limitation of process conditions, the actual impedance profile of the data lines of the liquid crystal panel is not in accordance with the curve shown in FIG. 2, but is rather similar to the one shown in FIG. 5. The horizontal coordinate in FIG. 5 indicates the numbers of different data lines, and the solid line in FIG. 5 illustrates the impedances of different data lines under practical conditions. With comparison to FIG. 2, it could be seen that the impedance profile of the data lines under practical conditions cannot form an arithmetic progression between the minimum impedance R1 and the reference impedance value R0, but exhibits certain irregular fluctuations.

FIG. 6 shows a compensation impedance profile in the prior art. The curve shown in FIG. 6 is consistent with the one shown in FIG. 3, which means that in the prior art, the compensation solution under the ideal condition is even adopted for practical conditions. With reference to FIG. 6, the black solid line illustrates impedance compensation values for data lines designated with different numbers in the prior art. In other words, with the compensation solution for data lines in the prior art, the impedance compensation values for data lines form an increasing arithmetic progression from data line X(1) to data line X(n), and a decreasing arithmetic progression from data line X(n+1) to data line X(2n), respectively. The impedance compensation values corresponding to data lines X(n) and X(n+1) are maximum, which equal R0-R1 from FIG. 5, namely the difference between the ideal impedance value and the minimum impedance value of the data lines.

However, the actual impedance profile of the data lines as shown in FIG. 5 deviates with irregular fluctuations from the impedance profile of the data lines under the ideal condition as shown in FIG. 2 due to practical processing conditions, and as a result of which, the actual compensated total load impedance by means of the compensation solution in the prior art is in accordance with the one shown in FIG. 7. The black solid line in FIG. 7 schematically illustrates a total load impedance of a data driving unit in the prior art. With reference to FIG. 7, it could be seen that under practical conditions, the fluctuation caused by the process conditions can not be improved, and the curve in FIG. 7 cannot be in accordance with the ideal image of FIG. 4. When the fluctuation amplitude of the process conditions reaches a certain degree, the display effect would be negatively affected, and certain display defects, such as vertical black and white strips, color shift, and the like, would be generated.

SUMMARY OF THE INVENTION

On the basis of the above-mentioned problem in the prior art, namely the compensated total load impedance is biased from the ideal total load impedance for the reason that the impedance fluctuation of data lines caused by practical process conditions cannot be eliminated through compensating impedance values of data lines in the prior art, an improved method for compensating impedance values of data lines is proposed according to the invention.

The present disclosure relates to a method for compensating impedances of data lines of a liquid crystal display.

The method includes the following steps: a setting step of setting a memory and a subtracter; a measuring step of measuring the impedance value of a data line to be compensated, and inputting the impedance value into the memory; a calculating step of performing calculations with the impedance value measured in the measuring step through the subtracter, so as to obtain an impedance compensation value required by the respective data line; and a compensating step of reading out the impedance compensation value acquired in the calculating step through a data driving unit, and performing impedance compensation on the respective data line based on the impedance compensation value, in order to obtain a total load impedance for the respective data line.

The function image of the total load impedance acquired with the method of the present disclosure exhibits a straight line, which means that the total load impedance values for all the data lines are equal. This is for the reason that the fluctuation of the impedance values of the data lines caused by practical process conditions is effectively compensated with the method of the present disclosure. A uniform and satisfactory display effect is ensured, with certain display defects, such as vertical black and white strips, color shift and the like, advantageously prevented.

Preferably, during the setting step, the memory and the subtracter are arranged on a printed circuit board of the liquid crystal display. With such an arrangement, the space taken in a panel, the manufacturing procedures and the manufacturing cost can be favorably reduced.

Preferably, during the measuring step, the impedance value of the data line to be compensated is measured by means of a contact measurement method or a non-contact measurement method. Thus, the actual impedance value of the data line to be compensated can be acquired accurately and conveniently, which lays a advantageous foundation for the calculating step and the compensating step.

Preferably, the measuring step is performed in an array substrate test procedure. In this way, process procedures and production cost can both be reduced.

Preferably, during the measuring step, the impedance values of all the data lines in both the display area and the non-display area of the liquid crystal display are measured.

In this way, all the data lines can be compensated at one time, which results in best compensation effect and displayed picture, effectively preventing vertical black and white strips or color shift and mura phenomenon.

Preferably, during the calculating step, the impedance compensation value is acquired by the subtracter through obtaining the difference between the impedance value of the data line measured in the measuring step and a reference impedance value. In this way, the impedance of the data line can be compensated most quickly, conveniently, efficiently and accurately, resulting in equal total load impedance outputs and uniform displayed pictures.

Preferably, the reference impedance value is the maximum impedance value for the data lines measured in the measuring step.

Preferably, after the compensating step, the total load impedances for all the data lines are equal. Thus, the difference of the impedances of the data lines is effectively compensated, which keeps the displayed pictures of the display uniform and prevents mura phenomenon and other display defects.

Preferably, the total load impedance is equal to the maximum impedance value for the data lines measured in the measuring step.

Preferably, given a quantity of 2n for the data lines, with the data lines successively numbered from one side to the other side, the impedance compensation values corresponding to the (n)th data line and the (n+1)th data line are equal and are the maximum among the acquired impedance compensation values, and/or, the impedance compensation values corresponding to the 1st data line and the (2n)th data line are equal and are the minimum among the acquired impedance compensation values. They are matched and complementary for the data line impedance value measured in the measuring step, thus ensuring the uniformity of the final total load impedance output.

With the method according to the present disclosure, the fluctuations of the impedance values of the data lines relative to the ideal theoretical value caused by practical process conditions are effectively compensated. A uniform and qualified display effect can thus be ensured without certain display defects, such as vertical black and white strips, color shift and the like.

The above-mentioned technical features may be combined in various appropriate manners or substituted by equivalent technical features, as long as the objective of the present disclosure can be fulfilled.

BRIEF DESCRIPTION OF THE DRAWINGS

The present disclosure will be described in more detail below based on merely nonfinite examples with reference to the accompanying drawings. Wherein.

Figure 1:
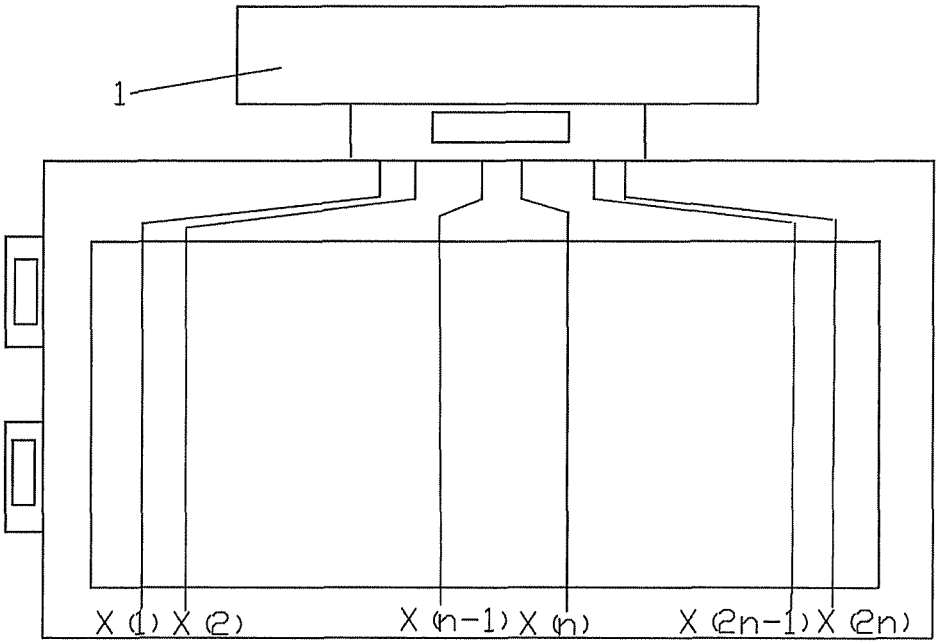
FIG. 1 shows a structural schematic diagram of an array substrate of a thin-film transistor liquid crystal display.

In the drawings, the same components are indicated by the same reference signs. The accompanying drawings are not drawn in an actual scale.

DETAILED DESCRIPTION OF THE EMBODIMENTS

The present disclosure will be introduced in detail below with reference to the accompanying drawings.

Figure 11:
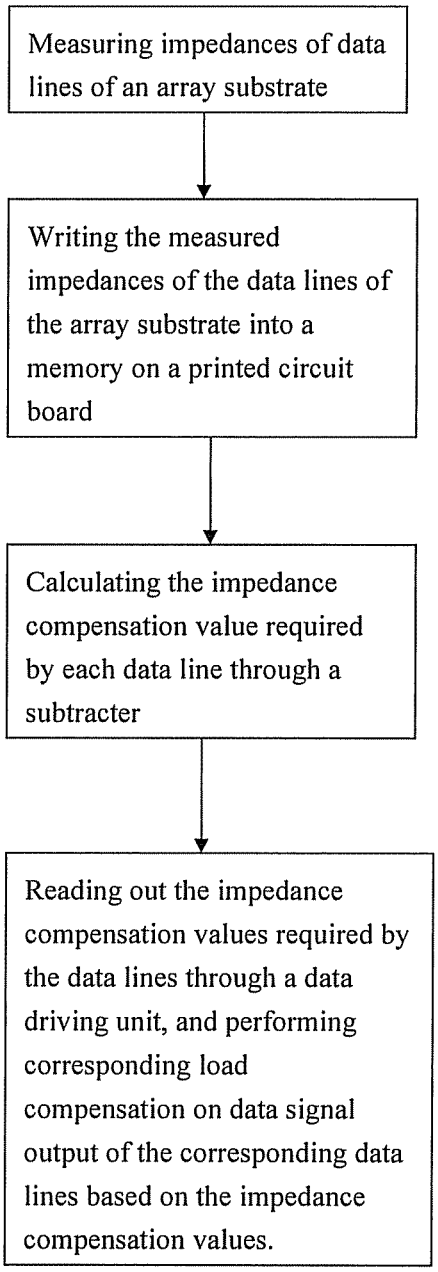
FIG. 11 shows a flow diagram of a method according to the present disclosure.

FIG. 11 shows a flow diagram of a method according to the present disclosure. Further understanding of the present disclosure could be facilitated with reference to FIG. 11.

According to the present disclosure, a method for compensating impedances of data lines of a liquid crystal display is proposed, which includes the following steps:

(1) Setting step: setting a memory and a subtracter

The memory and the subtracter may be arranged on a printed circuit board of the liquid crystal display. Namely, the memory and the subtracter can be arranged at the position on the printed circuit board 1 shown in FIG. 1.

(2) Measuring step: measuring the impedance value of a data line to be compensated, and inputting the impedance value into the memory The impedance value of the data line to be compensated may be measured by means of a contact measurement method or a non-contact measurement method. In order to reduce the processing time and cost, the measuring step may be performed in an array substrate test procedure. Preferably, the impedance values of all the data lines in both the display area and the non-display area of the liquid crystal display are measured. In this case, all the data lines can be compensated at one time, which leads to best compensation effect and displayed pictures, thus effectively preventing vertical black and white strips or color shift and mura phenomenon in any region.

(3) Calculating step: performing calculations with the impedance value measured in the measuring step through the subtracter, so as to obtain an impedance compensation value required by the respective data line.

The impedance compensation value can be acquired by the subtracter through acquiring the difference between the impedance value of the data line measured in the measuring step and a reference impedance value. The reference impedance value may be the maximum impedance value for the data lines measured in the measuring step.

(4) Compensating step: reading out the impedance compensation value acquired in the calculating step through a data driving unit, and performing impedance compensation on the respective data line based on the impedance compensation value, in order to obtain a total load impedance for the respective data line.

Preferably, after compensation, the total load impedances corresponding to all the data lines are equal. The total load impedance may be equal to the maximum impedance value for the data lines measured in the measuring step, for example.

In an embodiment, given a quantity of 2n for the data lines, with the data lines successively numbered from one side to the other side, the impedance compensation values corresponding to the (n)th data line and the (n+1)th data line are equal and are the maximum among the acquired impedance compensation values, and/or the impedance compensation values corresponding to the 1st data line and the (2n)th data line are equal and are the minimum among the acquired impedance compensation values.

The method according to the present disclosure will be described in detail in conjunction with the accompanying drawings.

Figure 2:
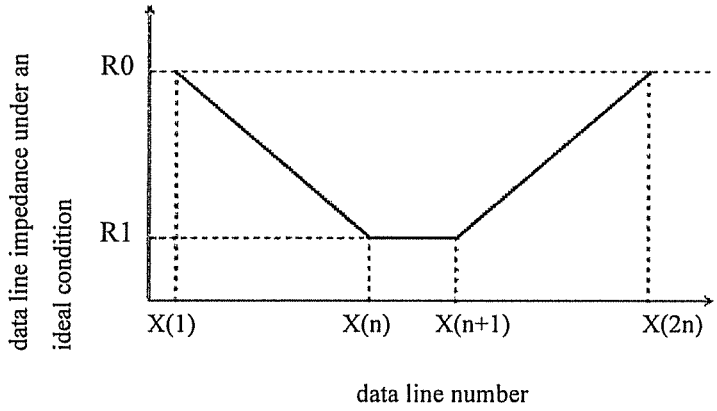
FIG. 2 shows an impedance profile of data lines under an ideal condition.
Figure 3:
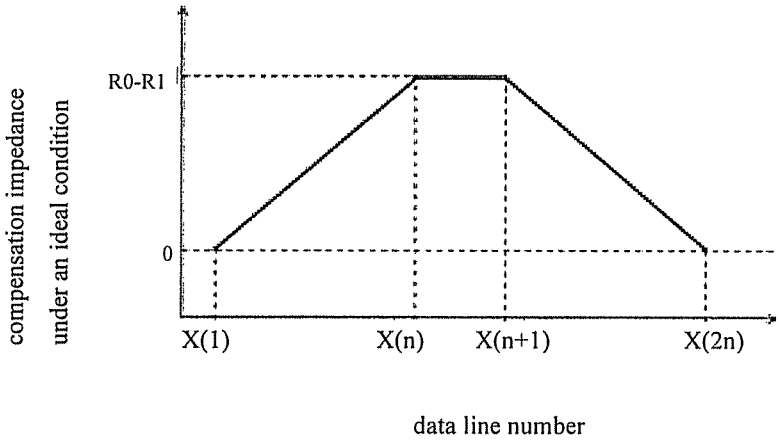
FIG. 3 shows a compensation impedance profile under the ideal condition.
Figure 5:
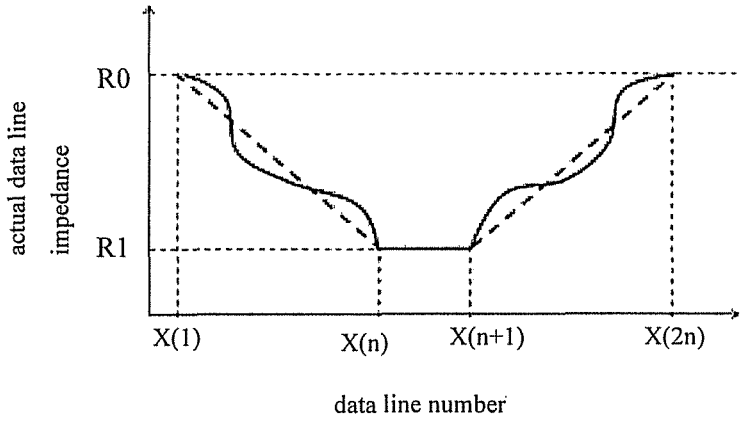
FIG. 5 shows an actual impedance profile of data lines in the prior art.
Figure 6:
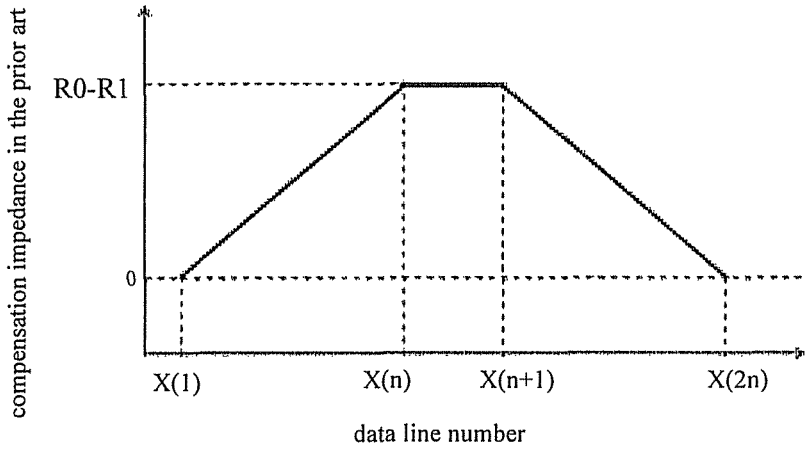
FIG. 6 shows a compensation impedance profile in the prior art.
Figure 7:
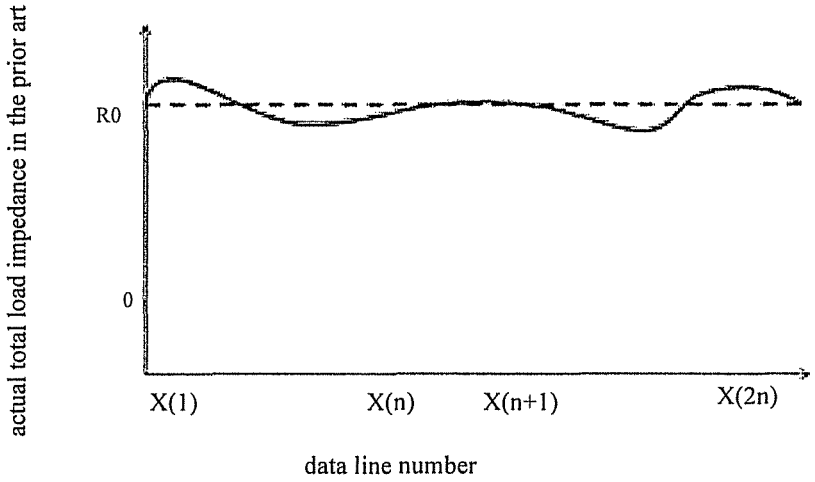
FIG. 7 shows a total load impedance profile of a data driving unit in the prior art.
Figure 8:
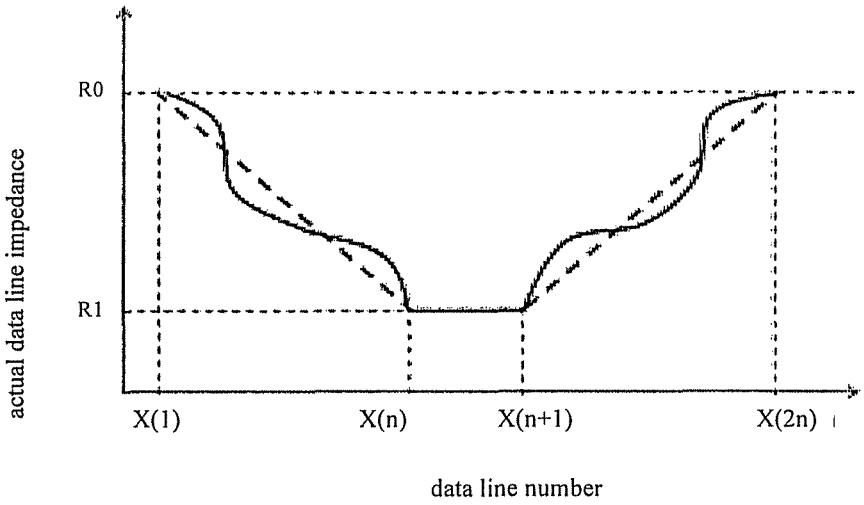
FIG. 8 schematically shows an actual impedance profile of data lines according to the present disclosure.

FIG. 8 schematically shows actual data line impedances measured in the measuring step. The curve shown in FIG. 8 is consistent with the one shown in FIG. 5, but different from the one shown in FIG. 2. This is for the reason that the actual impedance profile of the data lines cannot form an arithmetic progression, but instead, compared with the impedance profile of the data lines under the ideal condition as shown in FIG. 2, exhibits certain irregular fluctuations due to practical process conditions.

Figure 9:
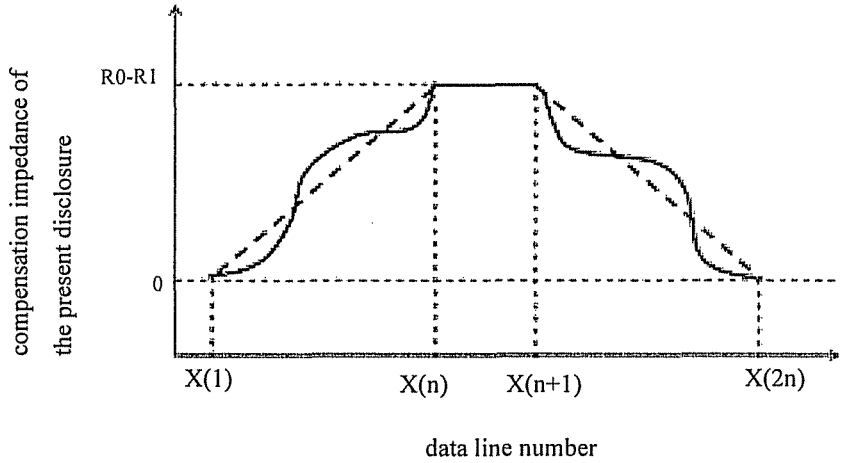
FIG. 9 schematically shows a compensation impedance profile according to the present disclosure.

FIG. 9 shows a compensation impedance profile of the method according to the present disclosure.

According to the method of the present disclosure, the impedance value of each data line is measured separately and stored in the memory. When the liquid crystal display is turned on, calculations are performed on the desired reference impedance value and the data line impedance value measured in the measuring step, shown in FIG. 8, by the subtracter, so as to obtain the difference therebetween, with the difference recorded as the required impedance compensation value.

With reference to FIG. 9, it could be seen that with the data line compensation solution according to the present disclosure, the impedance compensation values of the data lines form an overall rising progression with certain fluctuations from data line X(1) to data line X(n), and an overall descending progression with certain fluctuations from data line X(n+1) to data line X(2n), respectively. However, the curve is not a straight line, but provided with fluctuations. The curve of the impedance compensation values shown in FIG. 9 is provided with complementary fluctuations corresponding to the fluctuations of the impedance values in FIG. 8. The impedance compensation values corresponding to data lines X(n) and X(n+1) are maximum, which equal R0-R1 from FIG. 9, namely, the difference between the ideal impedance value and the minimum impedance value of the data lines.

Figure 4:
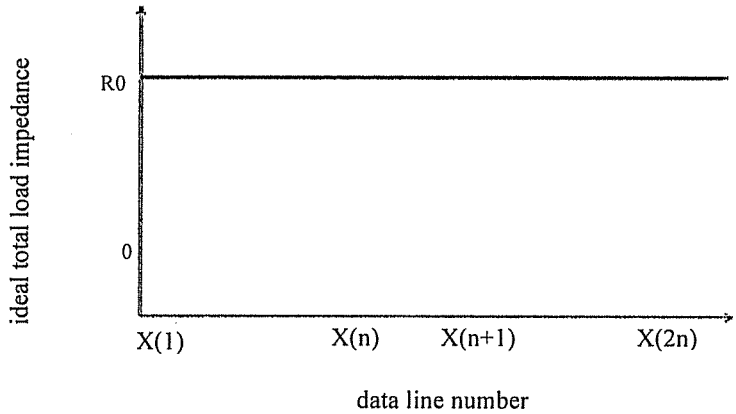
FIG. 4 shows a total load impedance profile of a data driving unit under the ideal condition.
Figure 10:
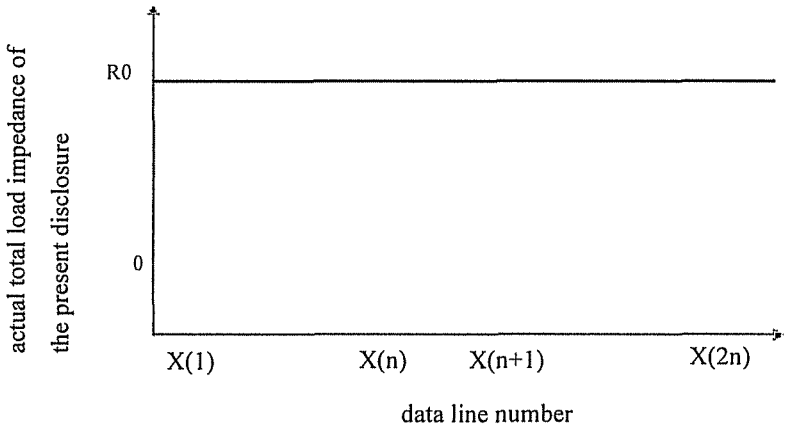
FIG. 10 shows a total load impedance profile of a data driving unit according to the present disclosure.

FIG. 10 shows a total load impedance of a data driving unit of the present disclosure. It could be seen that the function curve of the total load impedance obtained with the method of the present disclosure is a straight line, which means that the total load impedance values corresponding to all the data lines are equal to the ideal impedance value R0. This is due to the fact that the fluctuation of the impedance values of the data lines caused by practical process conditions is effectively compensated by means of the method of the present disclosure. The curve of FIG. 10 is identical with that of FIG. 4 which is under the ideal condition. Therefore, a uniform, satisfactory display effect can be ensured, with display defects, such as vertical black and white strips, color shift and the like, advantageously prevented.

Figure 12:
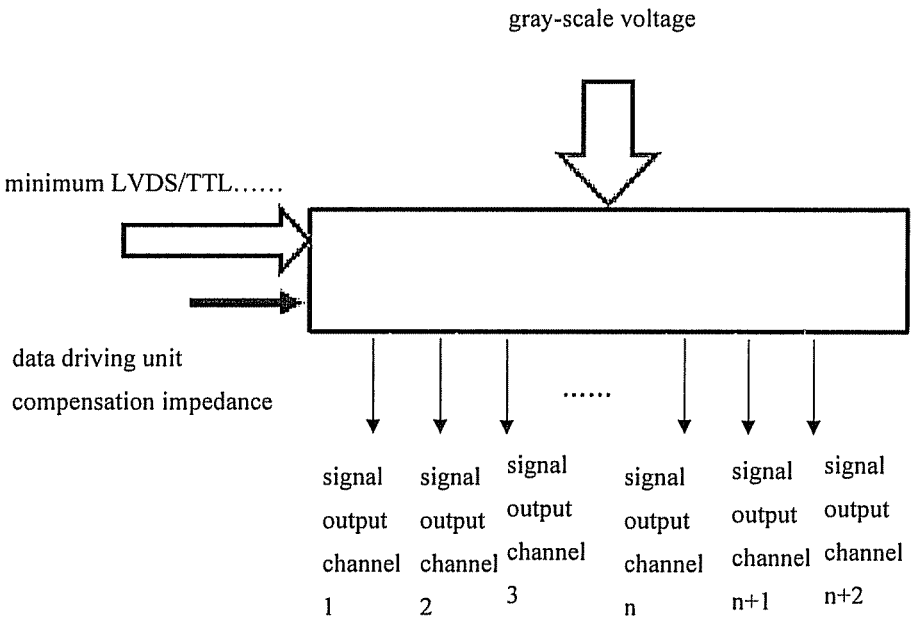
FIG. 12 shows a schematic diagram of signal input and output of the data driving unit according to the present disclosure.

FIG. 12 shows a schematic diagram of signal input and output of the data driving unit according to the present disclosure, with which understanding of the present disclosure can be facilitated. It could be seen that during the compensating step, the data driving unit receives signals of the impedance compensation values and outputs signals of total load impedance for the data lines.

Although the present disclosure has been described with reference to the preferred examples, various modifications could be made to the present disclosure without departing from the scope of the present disclosure and components in the present disclosure could be substituted by equivalents. The present disclosure is not limited to the specific examples disclosed in the description, but includes all technical solutions falling into the scope of the claims.

The invention claimed is:

1. A method for compensating impedances of data lines of a liquid crystal display, wherein the method includes the following steps:

a setting step of setting a memory and a subtracter, wherein the memory and the subtracter are arranged on a printed circuit board of the liquid crystal display;

a measuring step of measuring the impedance value of a data line to be compensated, and inputting the impedance value into the memory;

a calculating step of performing calculations with the impedance value measured in the measuring step through the subtracter, so as to obtain an impedance compensation value required by the respective data line; and a compensating step of reading out the impedance compensation value acquired in the calculating step through a data driving unit, and performing impedance compensation on the respective data line based on the impedance compensation value, in order to obtain a total load impedance for the respective data line, wherein given a quantity of 2n for the data lines, with the data lines successively numbered from one side to the other side, the impedance compensation values corresponding to the (n)th data line and the (n+1)th data line are equal and are the maximum among the acquired impedance compensation values, and/or, the impedance compensation values corresponding to the 1st data line and the (2n)th data line are equal and are the minimum among the acquired impedance compensation values.

2. The method according to claim 1, wherein during the measuring step, the impedance value of the data line to be compensated is measured by means of a contact measurement method or a non-contact measurement method.

3. The method according to claim 1, wherein the measuring step is performed in an array substrate test procedure.

4. The method according to claim 3, wherein during the calculating step, the impedance compensation value is acquired by the subtracter through obtaining the difference between the impedance value of the data line measured in the measuring step and a reference impedance value.

5. The method according to claim 4, wherein the reference impedance value is the maximum impedance value for the data lines measured in the measuring step.

6. The method according to claim 3, wherein after the compensating step, the total load impedances for all the data lines are equal.

7. The method according to claim 6, wherein the total load impedance is equal to the maximum impedance value for the data lines measured in the measuring step.

8. The method according to claim 1, wherein during the measuring step, the impedance values of all the data lines in both the display area and the non-display area of the liquid crystal display are measured.

9. The method according to claim 8, wherein during the calculating step, the impedance compensation value is acquired by the subtracter through obtaining the difference between the impedance value of the data line measured in the measuring step and a reference impedance value.

10. The method according to claim 9, wherein the reference impedance value is the maximum impedance value for the data lines measured in the measuring step.

11. The method according to claim 8, wherein after the compensating step, the total load impedances for all the data lines are equal.

12. The method according to claim 11, wherein the total load impedance is equal to the maximum impedance value for the data lines measured in the measuring step.

13. The method according to claim 1, wherein during the calculating step, the impedance compensation value is acquired by the subtracter through obtaining the difference between the impedance value of the data line measured in the measuring step and a reference impedance value.

14. The method according to claim 13, wherein the reference impedance value is the maximum impedance value for the data lines measured in the measuring step.

15. The method according to claim 1, wherein after the compensating step, the total load impedances for all the data lines are equal.

16. The method according to claim 15, wherein the total load impedance is equal to the maximum impedance value for the date lines measured in the measuring step.

* * * * *